US010677018B2

(12) United States Patent
Manlandro et al.

(10) Patent No.: US 10,677,018 B2
(45) Date of Patent: Jun. 9, 2020

(54) ACTUATOR MECHANISM FOR A VALVE SYSTEM

(71) Applicants: Adam James Manlandro, Broken Arrow, OK (US); Jason Edwards, Broken Arrow, OK (US)

(72) Inventors: Adam James Manlandro, Broken Arrow, OK (US); Jason Edwards, Broken Arrow, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/015,900

(22) Filed: Jun. 22, 2018

(65) Prior Publication Data

US 2019/0390533 A1 Dec. 26, 2019

(51) Int. Cl.
*E21B 34/14* (2006.01)
*E21B 34/00* (2006.01)

(52) U.S. Cl.
CPC ..... *E21B 34/14* (2013.01); *E21B 2034/005* (2013.01)

(58) Field of Classification Search
CPC ..... E21B 34/14; E21B 2034/005; E21B 34/08
See application file for complete search history.

(56) References Cited

U.S. PATENT DOCUMENTS

| | | | | |
|---|---|---|---|---|
| 5,310,005 | A * | 5/1994 | Dollison | E21B 21/10 137/527 |
| 5,575,306 | A | 11/1996 | Taylor | |
| 6,227,299 | B1 | 5/2001 | Dennistoun | |
| 2003/0079880 | A1 | 5/2003 | Deaton et al. | |
| 2008/0035353 | A1 | 2/2008 | Hughes et al. | |
| 2015/0330524 | A1* | 11/2015 | Talawar | F16K 15/03 137/527.8 |
| 2018/0016866 | A1* | 1/2018 | Caminari | E21B 34/10 |

FOREIGN PATENT DOCUMENTS

WO 2010056783 A2 5/2010

OTHER PUBLICATIONS

International Search Report and Written Opinion for International Application No. PCT/US2019/033495; International Filing Date May 22, 2019; Report dated Sep. 11, 2019 (pp. 1-9).

* cited by examiner

*Primary Examiner* — James G Sayre
(74) *Attorney, Agent, or Firm* — Cantor Colburn LLP

(57) ABSTRACT

An actuator mechanism for a valve system includes a housing having an outer surface, an inner surface defining an opening and a chamber extending partially about the housing between the outer surface and the inner surface. A hinge is mounted to the housing. The hinge is exposed at the chamber. A valve member is fixedly connected to the hinge. The valve member is selectively positionable across the opening. An actuator is arranged in the chamber and selectively biased against the hinge to transition the valve member between an open configuration and a closed configuration.

17 Claims, 5 Drawing Sheets

ACTUATOR MECHANISM FOR A VALVE SYSTEM

BACKGROUND

In the resource exploration and recovery industry, various valves are employed to control fluid flow. Safety valves, for example, are employed to prevent formation fluids from exiting a wellhead uncontrolled. A safety valve may take the form of a flapper valve. Flapper valves including opening and closing mechanisms. For example, a flapper valve may be opened by axially shifting a tubular or flow sleeve. The flow sleeve may contact and pass through a flapper thereby opening the valve. When an activating force is removed, e.g., the flow sleeve is withdrawn, a biasing system causes the flapper to return to a closed configuration.

Flapper valves typically are lengthy given the need to house the opening and closing mechanisms. Limitations on placement of the flapper valve are driven by valve length. The longer the valve, the more difficult to locate in certain portions of a downhole system leading to greater installation costs. Additionally, the longer valve contributes more frequent maintenance leading to higher operational costs. Accordingly, the art would appreciate a valve assembly having an operating mechanism that may take up less room thereby leading to a shorter housing length.

SUMMARY

Disclosed is an actuator mechanism for a valve system including a housing having an outer surface, an inner surface defining an opening and a chamber extending partially about the housing between the outer surface and the inner surface. A hinge is mounted to the housing. The hinge is exposed at the chamber. A valve member is fixedly connected to the hinge. The valve member is selectively positionable across the opening. An actuator is arranged in the chamber and selectively biased against the hinge to transition the valve member between an open configuration and a closed configuration.

Also disclosed is a resource exploration and recovery system including a first system and a second system fluidically connected to the first system. The second system includes one or more tubulars. At least one of the one or more tubulars supports a valve system including an actuator mechanism. The actuation mechanism includes a housing having an outer surface, an inner surface defining an opening and a chamber extending partially about the housing between the outer surface and the inner surface. A hinge is mounted to the housing. The hinge is exposed at the chamber. A valve member is fixedly connected to the hinge. The valve member is selectively positionable across the opening. An actuator is arranged in the chamber and selectively biased against the hinge to transition the valve member between an open configuration and a closed configuration.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
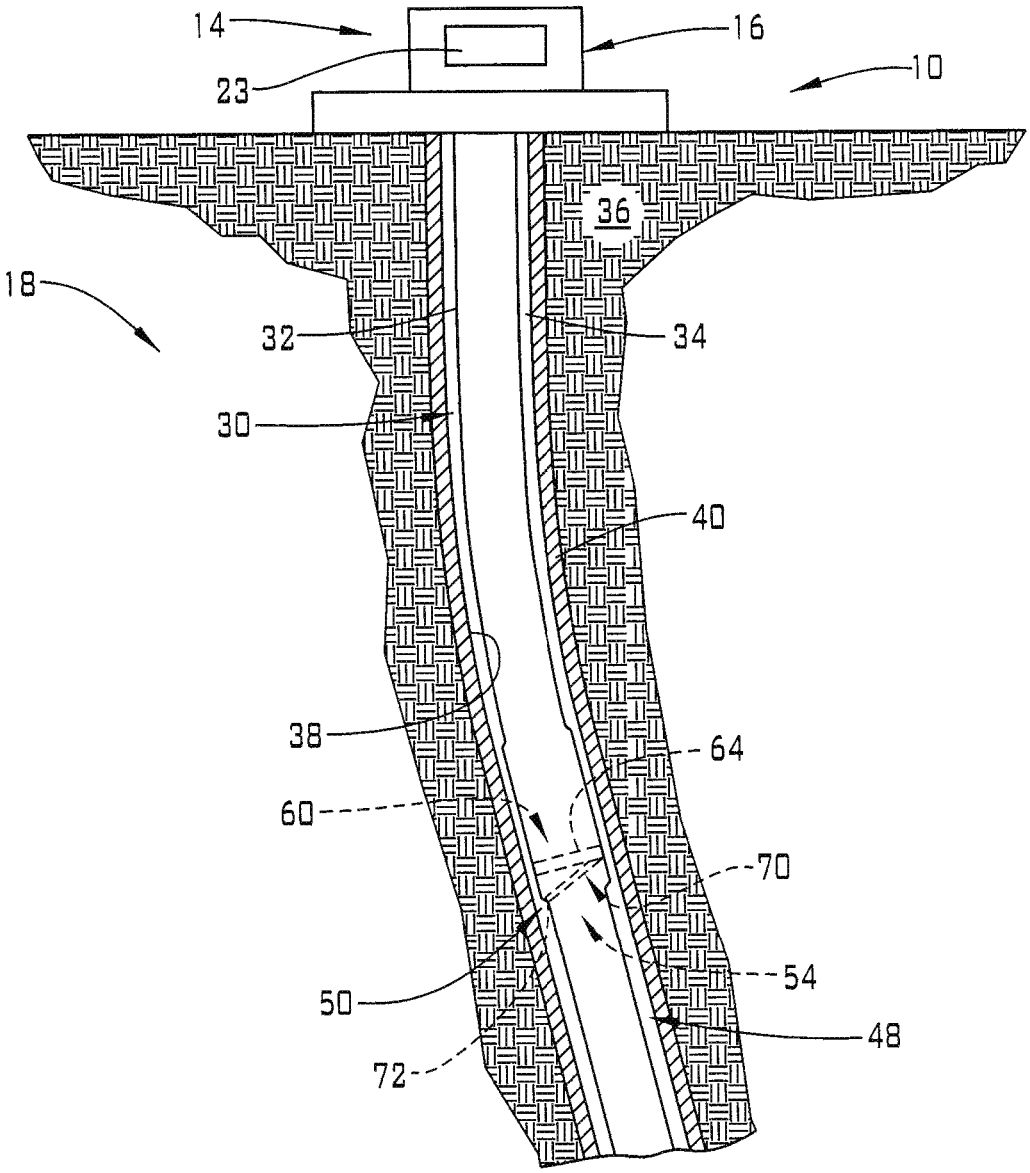
FIG. 1. depicts a resource exploration and recovery system including a valve system having a actuator mechanism, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, geothermal systems, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein. Surface system 16 may also include additional systems such as pumps, fluid storage systems, cranes and the like (not shown).

Second system 18 may include a tubular string 30, formed from one or more tubulars 32, which extends into a wellbore 34 formed in formation 36. Wellbore 34 includes an annular wall 38 which may be defined by a surface of formation 36, or a casing tubular 40 such as shown. In an exemplary aspect, tubular string 30 supports a downhole system 48 including a tubular 50 that houses a tool mechanism 54.

Figure 2:
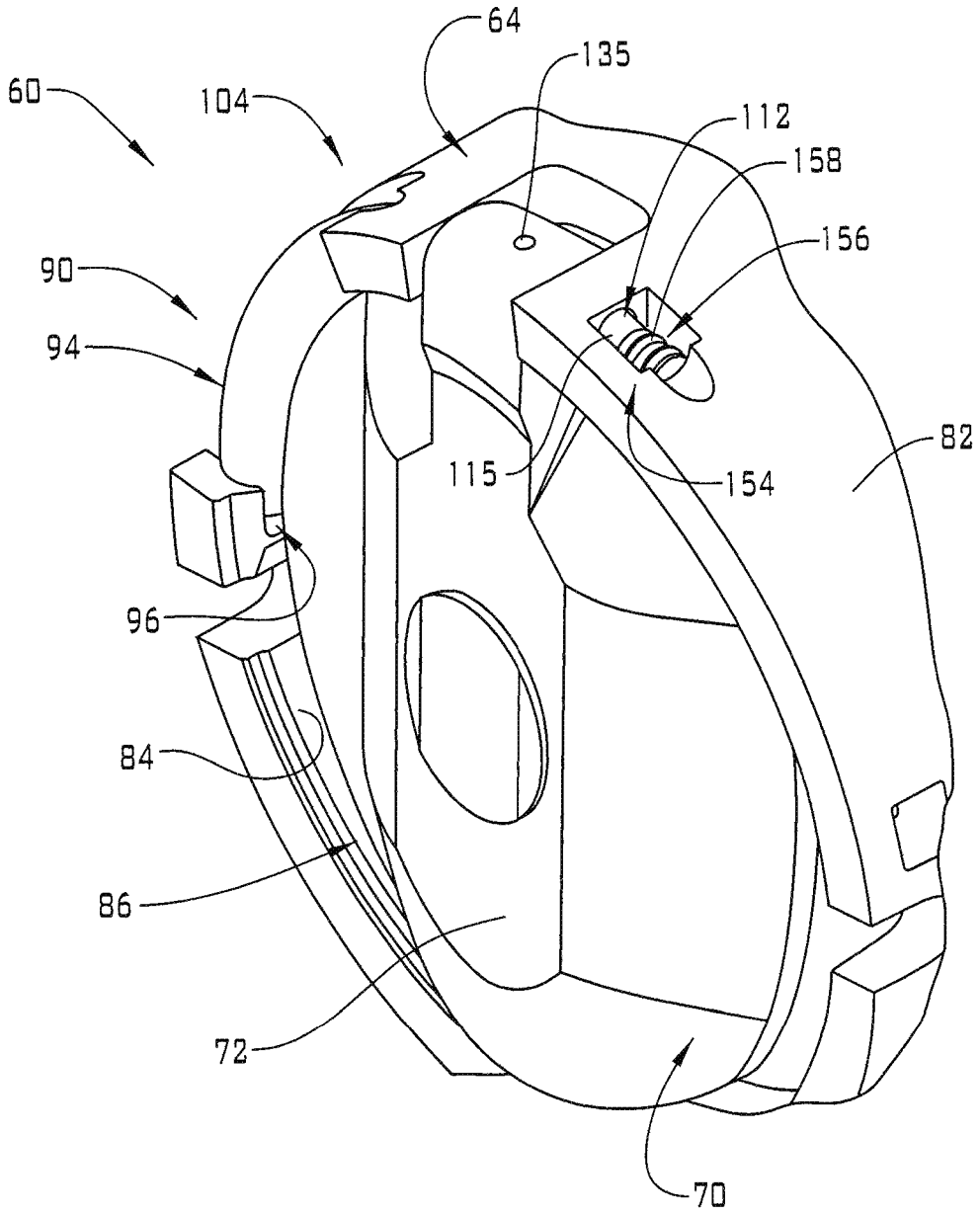
FIG. 2 depicts a partial perspective view of the valve system and actuator mechanism, in accordance with an aspect of an exemplary embodiment.
Figure 3:
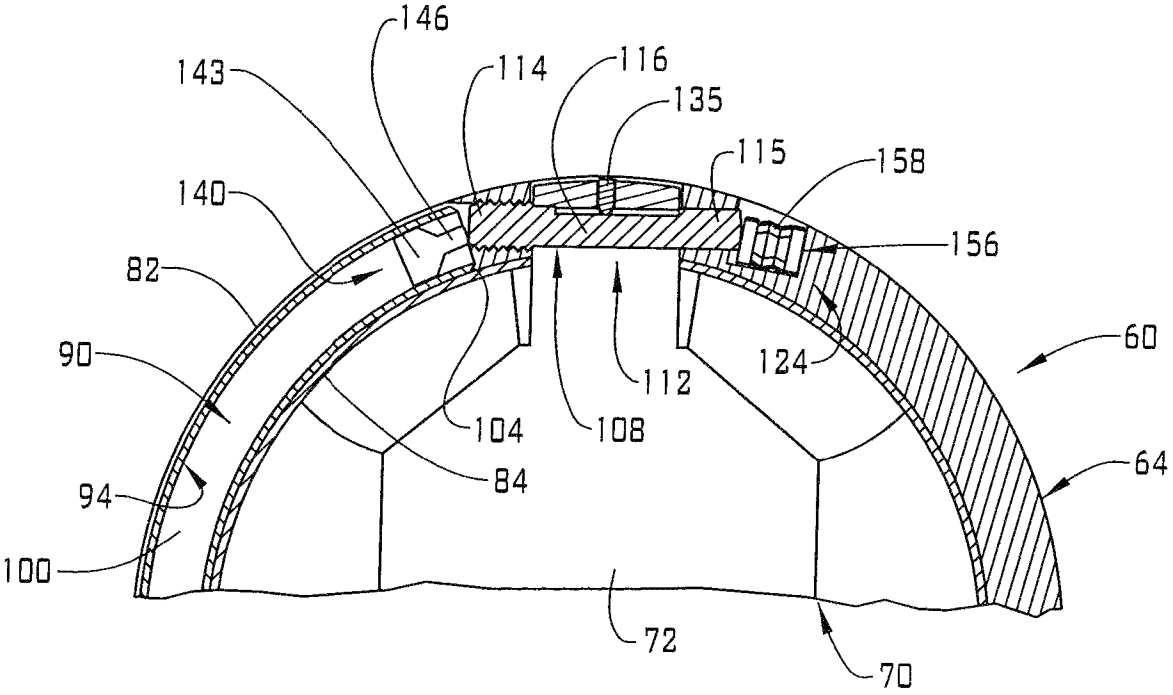
FIG. 3 depicts a partial cross-sectional end view of the valve system of FIG. 2, in accordance with an aspect of an exemplary embodiment.

In an embodiment, tool mechanism 54 may take the form of a surface safety valve (SSV) or subsurface safety valve (SSSV) 60 including a housing 64 and a valve member 70 that may take the form of a flapper 72. Referring to FIGS. 2 and 3 and with continued reference to FIG. 1, housing 64 of SSV 60 includes an outer surface 82 and an inner surface 84 that defines an opening 86. A chamber 90 is provided on housing 64. Chamber 90 defines a conduit 94 arranged in a recess 96 formed in housing 64. It should be understood that while shown as a separate component, conduit 94 could be integrated into housing 64. Conduit 94 includes an internal passage 100 having an inner surface section (not separately labeled) and a terminal end 104. Conduit 94 also includes an inlet (not shown) that may receive a control fluid (also not shown).

Figure 4:
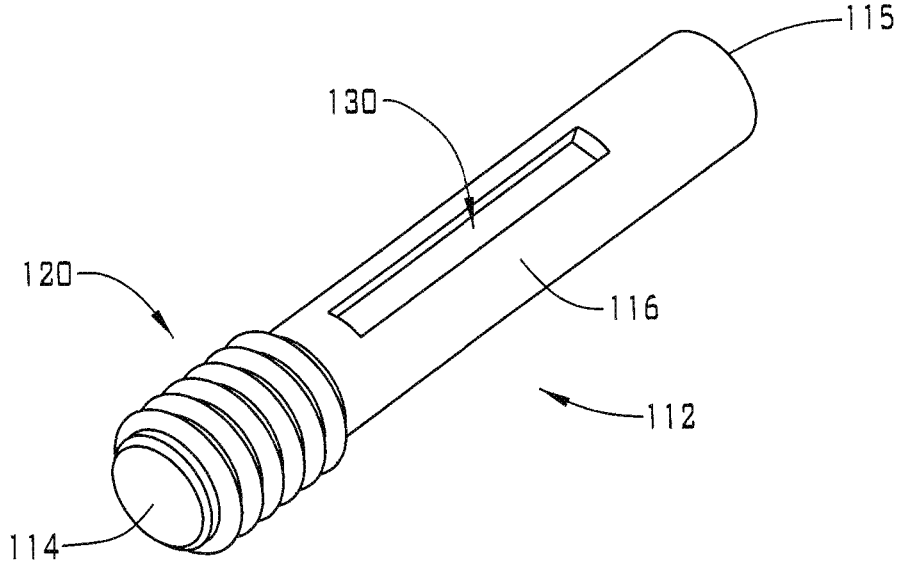
FIG. 4 depicts a hinge of the actuator system of FIG. 3, in accordance with an aspect of an exemplary embodiment.

In accordance with an exemplary aspect, flapper 72 is rotatably connected to housing 64 via an actuator mechanism 108 including a hinge 112. Referring to FIG. 4 and with continued reference to FIGS. 1-3, hinge 112 includes a first end 114 that may be exposed to passage 100, a second end 115, and an intermediate portion 116. In the exemplary aspect shown, first end 114 includes a threaded region (not separately labeled) having a plurality of threads 120 that inter-engage with corresponding threads (not separately labeled) on housing 64. Hinge 112 further includes a slot or channel 130 that receives a mechanical fastener, which may take the form of a set screw 135 (FIG. 3) that connects with flapper 72. It should be understood that the mechanical fastener may take on other forms. In this manner, hinge 112 may translate within housing 64 while also rotatably supporting flapper 72 as will be discussed herein.

In accordance with an exemplary aspect, actuator mechanism 108 also includes an actuator 140 arranged in internal passage 100 of conduit 94. Actuator 140 may take the form of a piston 143 having an actuator member 146 that may be selectively urged against first end 114 of hinge 112. Pressure applied to first end 114, causes hinge 112 to linearly translate from a first or home position in housing 64. The linear translation is converted to rotational movement through an interaction of plurality of threads 120 and the plurality of threads on housing 64. The rotational movement causes flapper 72 to transition between a closed configuration and an open configuration.

In still further accordance with an exemplary aspect, actuator mechanism 108 of SSV 60 includes a biasing element 124 arranged in housing 64 at second end 115 of hinge 112. Biasing element 124 acts about second end 114 of hinge 112 in a direction opposite to that of actuator member 146. In an embodiment, biasing element 124 may take the form of a spring mechanism 156. In an exemplary aspect, biasing element 124 may take the form of a Belleville stack 158. It should however be appreciated that biasing element 124 may take on a variety of forms. Biasing element 124 urges hinge axially in a direction opposite to that of actuator member 146. Specifically, once an activation force, such as control fluid pressure, is removed from actuator member 146 biasing element 124 urges hinge 112 to return to an initial or home position thereby returning flapper 72 to the closed configuration.

Figure 5:
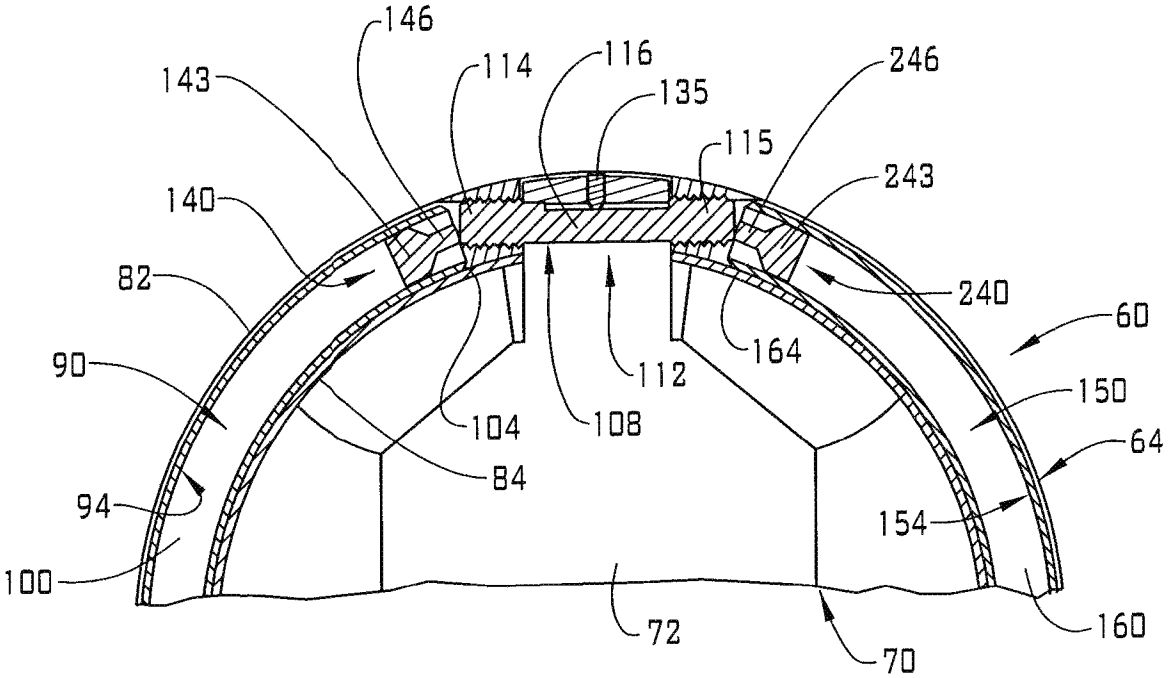
FIG. 5 depicts a partial cross-sectional end view of the valve system in accordance with another exemplary aspect.

Reference will now follow to FIG. 5, wherein like reference numbers represent corresponding parts in the respective views in describing another exemplary aspect of SSV 60. In the embodiment shown, SSV 60 includes another chamber 150 provided on housing 64. Chamber 150 defines another conduit 154 arranged in a recess (not shown) formed in housing 64. It should be understood that while shown as a separate component, conduit 154 could be integrated into housing 64. Conduit 154 includes an internal passage 160 having an inner surface section (not separately labeled) and a terminal end 164. Conduit 154 also includes an inlet (not shown) that may receive a control fluid (also not shown).

Another actuator 240 arranged in internal passage 160 of conduit 154. Another actuator 240 may take the form of a piston 243 having another actuator member 246 that may be selectively urged against second end 115 of hinge 112. Pressure applied to second end 115, causes hinge 112 to linearly translate back to the first or home position in housing 64. The linear translation is converted to rotational movement through an interaction of plurality of threads 120 and the plurality of threads on housing 64. The rotational movement causes flapper 72 to translate between a closed configuration and an open configuration. With this arrangement, actuator mechanism 108 fails in an as is configuration. That is, if a failure occurs after actuation of actuator 140, flapper 72 will not be biased back to the home configuration.

At this point it should be appreciated that the SSV described in connection with exemplary embodiments includes an actuator mechanism that is arranged at the flapper. Further the actuator mechanism is operable to open and close the flapper without the need for a flow sleeve and other related structure. In this manner, the SSV in accordance with exemplary embodiments may be more compact, and easier to service thereby providing greater flexibility in placement and maintenance thereby reducing operational costs.

Set forth below are some embodiments of the foregoing disclosure:

Embodiment 1

An actuator mechanism for a valve system comprising: a housing including an outer surface, an inner surface defining an opening and a chamber extending partially about the housing between the outer surface and the inner surface; a hinge mounted to the housing, the hinge being exposed at the chamber; a valve member fixedly connected to the hinge, the valve member being selectively positionable across the opening; and an actuator arranged in the chamber and selectively biased against the hinge to transition the valve member between an open configuration and a closed configuration.

Embodiment 2

The actuator mechanism for the valve system according to any prior embodiment, wherein the hinge includes a first end, a second end and an intermediate portion, at least one of the first end and the second end including a threaded region.

Embodiment 3

The actuator mechanism for the valve system according to any prior embodiment, wherein the first end of the hinge is exposed at the chamber and to the actuator.

Embodiment 4

The actuator mechanism for the valve system according to any prior embodiment, further comprising: a biasing element arranged in the housing at the second end of the hinge.

Embodiment 5

The actuator mechanism for the valve system according to any prior embodiment, wherein the biasing element comprises a spring mechanism.

Embodiment 6

The actuator mechanism for the valve system according to any prior embodiment, wherein the biasing element comprises a Belleville stack.

Embodiment 7

The actuator mechanism for the valve system according to any prior embodiment, further comprising: a mechanical fastener passing through the valve member into the hinge.

Embodiment 8

The actuator mechanism for the valve system according to any prior embodiment, wherein the actuator comprises a piston arranged in the chamber.

Embodiment 9

The actuator mechanism for the valve system according to any prior embodiment, further comprising: another chamber extending partially about the housing between the outer surface and the inner surface; and another actuator arranged in the another chamber, the another actuator being selectively biased against the hinge to transition the valve member between an open configuration and a closed configuration.

Embodiment 10

A resource exploration and recovery system comprising: a first system, a second system fluidically connected to the first system, the second system including one or more tubulars, at least one of the one or more tubulars supporting a valve system including an actuator mechanism comprising: a housing including an outer surface, an inner surface defining an opening and a chamber extending partially about the housing between the outer surface and the inner surface; a hinge mounted to the housing, the hinge being exposed at the chamber; a valve member fixedly connected to the hinge, the valve member being selectively positionable across the opening; and an actuator arranged in the chamber and selectively biased against the hinge to transition the valve member between an open configuration and a closed configuration.

Embodiment 11

The resource exploration and recovery system according to any prior embodiment, wherein the hinge includes a first end, a second end and an intermediate portion, at least one of the first end and the second end including a threaded region.

Embodiment 12

The resource exploration and recovery system according to any prior embodiment, wherein the first end of the hinge is exposed at the chamber and to the actuator.

Embodiment 13

The resource exploration and recovery system according to any prior embodiment, further comprising: a biasing element arranged in the housing at the second end of the hinge.

Embodiment 14

The resource exploration and recovery system according to any prior embodiment, wherein the biasing element comprises a spring mechanism.

Embodiment 15

The resource exploration and recovery system according to any prior embodiment, wherein the biasing element comprises a Belleville stack.

Embodiment 16

The resource exploration and recovery system according to any prior embodiment, further comprising: a mechanical fastener passing through the valve member into the hinge.

Embodiment 17

The resource exploration and recovery system according to any prior embodiment, wherein the actuator comprises a piston arranged in the chamber.

Embodiment 18

The resource exploration and recovery system according to any prior embodiment, wherein the valve system defines one of a surface safety valve (SSV) and a subsurface safety valve (SSSV) system.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An actuator mechanism for a valve system comprising:

a housing including an outer surface, an inner surface defining an opening and an annular chamber extending partially annularly about the housing between the outer surface and the inner surface;

a hinge mounted to the housing, the hinge being exposed at the annular chamber;

a valve member fixedly connected to the hinge, the valve member being selectively positionable across the opening; and an actuator comprising a piston arranged in the annular chamber and selectively biased against the hinge through application of a control fluid to transition the valve member between an open configuration and a closed configuration.

2. The actuator mechanism for the valve system according to claim 1, wherein the hinge includes a first end, a second end and an intermediate portion, at least one of the first end and the second end including a threaded region.

3. The actuator mechanism for the valve system according to claim 2, wherein the first end of the hinge is exposed at the annular chamber and to the actuator.

4. The actuator mechanism for the valve system according to claim 2, further comprising: a mechanical fastener passing through the valve member into the hinge.

5. The actuator mechanism for the valve system according to claim 3, further comprising: a biasing element arranged in the housing at the second end of the hinge.

6. The actuator mechanism for the valve system according to claim 5, wherein the biasing element comprises a spring mechanism.

7. The actuator mechanism for the valve system according to claim 5, wherein the biasing element comprises a Belleville stack.

8. The actuator mechanism for the valve system according to claim 1, further comprising:

another annular chamber extending partially annularly about the housing between the outer surface and the inner surface; and another actuator arranged in the another annular chamber, the another actuator being selectively biased against the hinge through application of a control fluid to transition the valve member between an open configuration and a closed configuration.

9. A resource exploration and recovery system comprising:

a first system, a second system fluidically connected to the first system, the second system including one or more tubulars, at least one of the one or more tubulars supporting a valve system including an actuator mechanism comprising:

a housing including an outer surface, an inner surface defining an opening and an annular chamber extending partially annularly about the housing between the outer surface and the inner surface;

a hinge mounted to the housing, the hinge being exposed at the annular chamber;

a valve member fixedly connected to the hinge, the valve member being selectively positionable across the opening; and an actuator comprising a piston arranged in the annular chamber and selectively biased against the hinge through application of a control fluid to transition the valve member between an open configuration and a closed configuration.

10. The resource exploration and recovery system according to claim 9, wherein the hinge includes a first end, a second end and an intermediate portion, at least one of the first end and the second end including a threaded region.

11. The resource exploration and recovery system according to claim 10, wherein the first end of the hinge is exposed at the annular chamber and to the actuator.

12. The resource exploration and recovery system according to claim 11, further comprising: a biasing element arranged in the housing at the second end of the hinge.

13. The resource exploration and recovery system according to claim 12, wherein the biasing element comprises a spring mechanism.

14. The resource exploration and recovery system according to claim 12, wherein the biasing element comprises a Belleville stack.

15. The resource exploration and recovery system according to claim 9, further comprising: a mechanical fastener passing through the valve member into the hinge.

16. The resource exploration and recovery system according to claim 9, wherein the valve system defines one of a surface safety valve (SSV) and a subsurface safety valve (SSSV) system.

17. The resource exploration and recovery system according to claim 9, wherein the actuator mechanism further comprises:

another annular chamber extending partially annularly about the housing between the outer surface and the inner surface; and another actuator arranged in the another annular chamber, the another actuator being selectively biased against the hinge through application of a control fluid to transition the valve member between an open configuration and a closed configuration.

* * * * *